United States Patent [19]

Naumann et al.

[11] Patent Number: 4,809,590

[45] Date of Patent: Mar. 7, 1989

[54] SEALING ARRANGEMENT FOR ROTARY VANE-TYPE MOTORS

[75] Inventors: Johannes Naumann; Hans-Jürgen Tappert, both of Coswig; Klaus Schrader; Bernhard Klose, both of Zwickau; Bob Dietrich, Gahlenz, all of German Democratic Rep.

[73] Assignee: VEB Kombinat Polygraph "Werner Lamberz" Leipzig, Leipzig, German Democratic Rep.

[21] Appl. No.: 905,748

[22] Filed: Sep. 9, 1986

[30] Foreign Application Priority Data

Sep. 9, 1985 [DD] German Democratic Rep. ... 280415

[51] Int. Cl.[4] ..... F01C 19/00; F16J 15/34

[52] U.S. Cl. ..... 92/125; 277/81 P; 277/92; 277/170; 277/176; 277/187; 277/193

[58] Field of Search ..... 277/190, 192, 168, 170, 277/188 R, 12, 214, 184, 171, 81 P, 92, 95, 193, 194; 415/110, 111, 113; 384/477, 479, 489, 130, 563, 565, 481, 482; 418/104, 149, 139, 142, 132, 140, 144, 131; 92/121, 122, 123

[56] References Cited

U.S. PATENT DOCUMENTS

| | | | |
|---|---|---|---|
| 1,305,133 | 5/1919 | Little | 418/139 |
| 2,904,355 | 9/1959 | Creamer | 277/170 X |
| 3,073,251 | 1/1963 | Weigert | 418/132 |
| 3,131,610 | 5/1964 | Paulus | 92/125 |
| 3,179,018 | 4/1965 | Rumsey | 92/122 X |
| 3,195,421 | 7/1965 | Rumsey et al. | 92/125 X |
| 3,269,737 | 8/1966 | Freese | 277/190 X |
| 3,455,563 | 7/1969 | Gies et al. | 277/92 X |
| 3,501,209 | 3/1970 | Endt | 384/563 |
| 3,539,282 | 11/1970 | Forschner | 418/132 |
| 3,575,538 | 4/1971 | Berkowitz et al. | 418/149 X |
| 3,632,240 | 1/1972 | Dworak | 418/131 |
| 3,809,509 | 5/1974 | Lamm | 418/149 X |
| 3,833,319 | 9/1974 | Eglington | 418/132 |
| 3,865,387 | 2/1975 | Larker et al. | 277/190 |
| 3,961,872 | 6/1976 | Muller et al. | 418/132 |
| 4,309,158 | 1/1982 | Grabow et al. | 418/132 |
| 4,443,168 | 4/1984 | Dworak et al. | 418/131 |
| 4,495,856 | 1/1985 | Sollami | 92/125 |

FOREIGN PATENT DOCUMENTS

| | | | |
|---|---|---|---|
| 1576095 | 6/1969 | Fed. Rep. of Germany | 92/125 |
| 1303585 | 5/1972 | Fed. Rep. of Germany | 92/125 |
| 645974 | 11/1928 | France | 277/190 |

*Primary Examiner*—Allan N. Shoap
*Attorney, Agent, or Firm*—Michael J. Striker

[57] ABSTRACT

A device for sealing surfaces defined between a collar of a motor shaft and a motor cover comprises a prestressed sealing ring mounted at the surfaces which extend at right angles relative to each other, a viscous elastic element for prestressing the sealing ring, and a guide ring positioned between the elastic element and the sealing ring. The sealing ring is positioned between the surfaces to be sealed and is pressed by the guide ring which is displaceable by a pressure medium.

13 Claims, 2 Drawing Sheets

SEALING ARRANGEMENT FOR ROTARY VANE-TYPE MOTORS

BACKGROUND OF THE INVENTION

The present invention relates to a device for sealing surfaces between a motor shaft and a motor end cover of a pressure medium-driven rotary vane-type motor.

A pressure chamber sealing arrangement for a hydraulically operated vane-type or impeller motor has been disclosed in DE-AS No. 130 3585. In this conventional arrangement, the pressure chambers are sealed by triangular pressure rings which are pre-stressed in the direction of the sealing surfaces. The sealing principle has been based on a partial lifting of the sealing ring from the sealing surfaces.

The disadvantage of this known sealing arrangement resides in that, due to the stream of the pressure medium flowing into the sealing gap an erosion occurs, and also the sealing gap becomes contaminated by particles contained in the pressure medium whereby increased wear of the sealing surfaces takes place and the gap is enlarged. Leakage is also increased while a friction force is enhanced and efficiency is reduced.

A further disadvantage of the known sealing device resides in shorter lengths of the guiding faces of the sealing ring, which can cause clamping and twisting of the pressure ring.

Furthermore, the motor has a great number of the sealing surfaces and thus is expensive to manufacture.

SUMMARY OF THE INVENTION

It is an object of the present invention to provide an improved sealing for sealing surfaces between a motor shaft an end cover of the motor.

It is another object of this invention to provide a sealing arrangement for vane-type rotary motors, which is easy to manufacture and reliable in operation and by means of which penetration of pressure medium and contamination particles into the sealing gap would be avoided.

Yet another object of the invention is to provide a sealing device, which would prevent the occurrence of corrosion, cavitation and extensive wear due to contamination in the region of the surfaces being sealed.

These and other objects of the invention are attained by a device for sealing a pressure medium-driven vane-type motor in which sealing surfaces to be sealed are defined between a collar of a motor shaft and a motor cover, the device comprising a pre-stressed sealing ring mounted at said surfaces which extend at right angles relative to each other, a viscous elastic element pre-stressing said sealing ring; and a guide ring positioned between said elastic element and said sealing ring in the direction of the axis of the motor shaft, said sealing ring being positioned between said surfaces to be sealed and being pressed by said guide ring which is displaceable by a pressure medium and continually generates between said sealing ring and said sealing surfaces of contact pressure which is greater than a working pressure of the pressure medium.

The sealing ring may have, at a radial side surface thereof lying against a sealing surface of said motor cover, an annular groove.

The sealing ring may be made of metallic or non-metallic material which has good sliding properties.

The collar of the motor shaft may have, at a sealing surface thereof, a recess.

The guide ring may have an oblique surface for receiving the sealing ring.

The guide ring may have a rectangular recess. The sealing arrangement may also include a triangular intermediate ring, said recess receiving said sealing ring and said intermediate ring.

The sealing ring may be triangular in shape and has an oblique surface, said intermediate ring having an oblique surface corresponding to and abutting against the oblique surface of said sealing ring.

The viscous elastic element may be an O-ring.

The sealing ring in the direction of the axis of the motor shaft may comprise a support ring and a sliding ring extending beyond side surfaces of said support ring.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
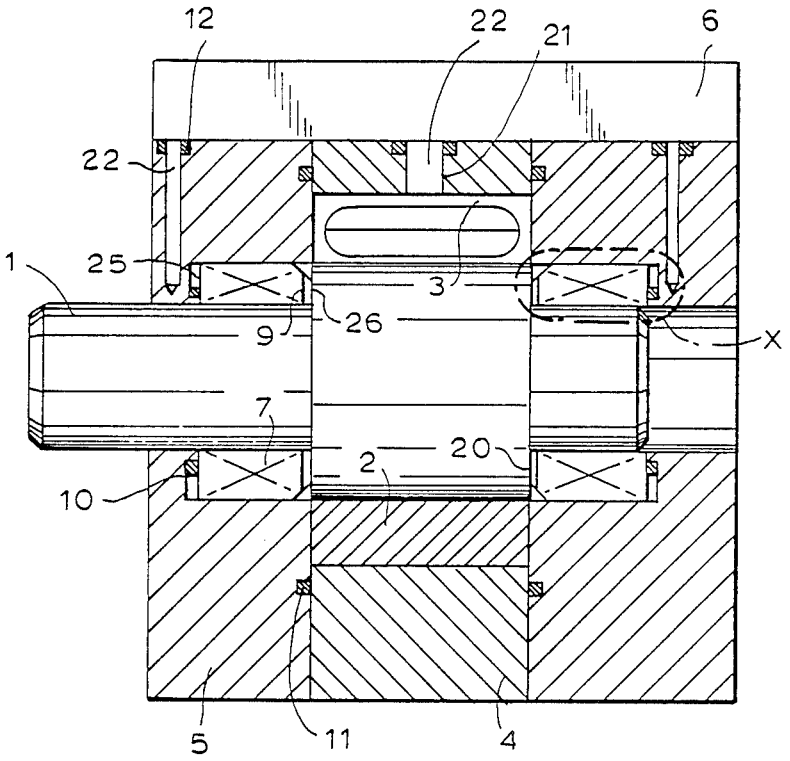
FIG. 1 is an axial sectional view of the vane-type motor.

Referring now to the drawings in detail, FIG. 1 shows an axial sectional view through a vane-type or propeller motor which includes a motor shaft 1 provided with a collar or flange 20. A plurality of vanes 2 which are separated from each other by pressure chambers 3 are positioned on the flange 20. Pressure chambers 3 are connected to a feeding channel 21 for a pressure medium 22 which is contained in a housing ring 4 surrounding vanes 2 and pressure chambers 3. The vanes 2, pressure chambers 3 and housing ring 4 are closed at two end faces by end covers 5 and by a locking or closing plate 6. Each cover 5 is supported on the motor shaft 1 via a guide ring 7 which is axially displaceable in the cover. The respective external end surface 25 of each guide ring 7 is loaded with pressure medium 22 via a pressure channel 8. A working pressure is applied to the pressure medium by a non-shown but conventional valve control.

Figure 2:
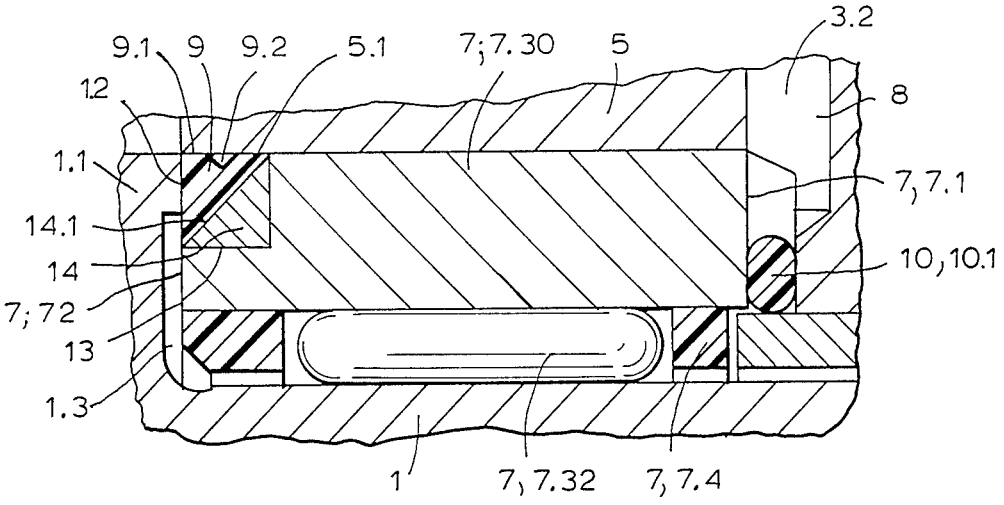
FIG. 2 is a unit X of FIG. 1, on an enlarged scale.
Figure 3:
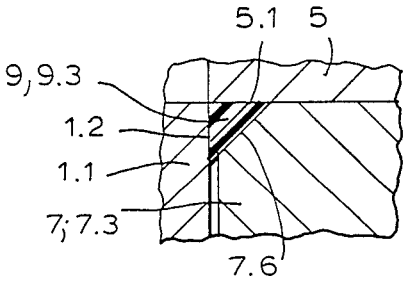
FIG. 3 is a partial sectional view showing a sealing ring according to a first embodiment.
Figure 4:
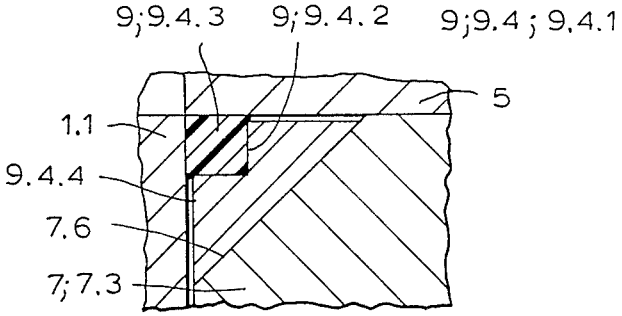
FIG. 4 is a sectional view of a second embodiment of the sealing ring.

As shown in FIGS. 2–4, between the end face 25 of each guide ring 7 and each end cover 5, is inserted a viscous elastic element 10 provided for sealing in an outward direction and for pre-stressing of a sealing ring 9 arranged between an opposing end face 26 of the guide ring 7 and the flange 20 of the motor shaft 1. Elastic element 10 is formed as an O-ring. The sealing ring 9 can be of various modifications as shown in FIGS. 2 through 4.

The sealing in the radial outward direction is carried out by sealing rings 11 (FIG. 1) which are accommodated in the end covers 5 and are applied at both sides to the housing ring 4. The feeding channel 21 and the pressure channels 8 are sealed from outside by seals 12.

The unit X of the vane-type motor is shown in detail in FIG. 2. This figure illustrates the guide ring 7 provided on the motor shaft and positioned in cover 5, the guide ring 7 being formed as a needle bearing. The guide ring assembly is comprised of a ring 30 and needles 32 lying between external rings 34. The axial sealing surface 36 of flange 20 is provided with a recess 38. At right angles to the sealing surface 36 of the flange or collar 20, is positioned a radial sealing surface 40 of cover 5. The ring 30 of the guide ring assembly in the region of the two intersecting sealing surfaces 36 and 40, which also extend perpendicular to each other, is provided with a rectangular recess 13. A triangular intermediate ring 14 is situated in that recess 13. The sealing ring 9 lies on an oblique surface 42 of the intermediate ring 14. The sealing ring 9 has at a radial side surface 41 lying against the sealing surface 40 of cover 5, an annular groove 45. Between the opposite end face 46 of the needle bearing 7 and the cover 5, is positioned the aforementioned viscous elastic ring 10. The end face 46 of the needle bearing 7 is loaded via channel 8 with pressure medium 22.

A further modified embodiment of the sealing ring 9 is shown in FIG. 3. In this embodiment, the guide ring 30 has in the region of the sealing surfaces 36 and 40, an oblique surface 48 for receiving a triangular-shaped sealing ring 9.

FIG. 4 illustrates yet another embodiment of the sealing ring 9. The two-part sealing ring 9 is comprised of a supporting ring 52 which lies against the oblique surface 48 of the guide ring 30 and is provided with a rectangular groove 55 at the opposite corner. A rectangular slide ring 50 is situated in groove 55; this slide ring extends over the side surfaces 56 of the support ring 52. The slide ring 50 can be metallic or non-metallic but should be formed of material with good sliding properties.

The sealing of the sealing surfaces 36 and 40 between the motor shaft 1 and the motor cover 5 of the pressure medium-driven impeller motor takes place so that the guide ring 30 of the guide ring assembly 7 pre-stressed by the O-ring 10 is loaded via channel 8 with pressure medium 22 and is pressed against the sealing ring 9 so that the sealing ring 9 continually abuts against the sealing surfaces of collar 20 of the motor shaft and the sealing surface 40 of the motor cover 5.

Due to the structure of the sealing ring 9 as described, splitting up of the force resulting from the pressure loading of the end face 56 of the guide ring 30 into a radial and axial components is obtained, which leads to a uniform contact pressure between the sealing ring 9 and the sealing surfaces 36 and 40.

By various dimensions of the pressure-medium loaded end face 56 of the guide ring 30 and axial and radial slide surfaces 44 of sealing ring 9, lying on the sealing surfaces 36 and 40, a predetermined force transmission ratio would result so that the sealing ring 9 will be pressed against sealing surfaces 36 and 40 under all operational conditions.

Due to the sealing arrangement according to the invention a constant abutting of the sealing ring 9 against sealing surfaces 36 and 40 is obtained and penetration of pressure medium 22 and lubrication particles into the sealing gap between collar 20 and cover 5 will be prevented.

The occurrence of stream erosion, cavitation and increased wear due to contamination in the region of the sealing surfaces are thereby avoided.

It will be understood that each of the elements described above, or two or more together, may also find a useful application in other types of sealing arrangements for vane-type motors differing from the types described above.

While the invention has been illustrated and described as embodied in a sealing arrangament for vane-type motors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for sealing a pressure medium-driven rotary vane-type motor in which two sealing surfaces to be sealed are defined between a collar of a motor shaft having an axis and a motor end cover and extended at right angles relative to each other, the sealing device comprising a prestressed sealing ring mounted at said surfaces so as to simultaneously seal said two surfaces against a pressure medium; a viscous elastic element prestressing said sealing ring, said sealing ring being made of a material having good sliding properties; and a guide ring displaceable by the pressure medium and positioned between said elastic element and said sealing ring in the direction of said axis, said guide ring having a length in the direction of said axis that is at least greater than twice the length in the direction of said axis of said sealing ring, said sealing ring being positioned between said surfaces to be sealed and being pressed by said guide ring which continually generates between said sealing ring and said sealing surfaces a contact pressure which is greater than a working pressure of the pressure medium.

2. A device as defined in claim 1, wherein said sealing ring has, at a radial side surface thereof lying against a sealing surface of said motor cover, an annular groove.

3. A device as defined in claim 1, wherein said sealing ring is made of metallic material.

4. A device as defined in claim 1, wherein said sealing ring is made of non-metallic material.

5. A device as defined in claim 1, wherein said collar has at a sealing surface thereof a recess.

6. A device as defined in claim 1, wherein said guide ring has an oblique surface for receiving said sealing ring.

7. A device as defined in claim 1, wherein said guide ring has a rectangular recess; and further including a triangular intermediate ring, said recess receiving said sealing ring and said intermediate ring.

8. A device as defined in claim 7, wherein said sealing ring is triangular in shape and has an oblique surface, said intermediate ring having an oblique surface corresponding to and abutting against the oblique surface of said sealing ring.

9. A device as defined in claim 1, wherein said elastic element is an O-ring.

10. A device as defined in claim 1, wherein said sealing ring is comprised of a support ring and a sliding ring extending beyond side surfaces of said support ring.

11. A device as defined in claim 1, wherein said sealing ring is of triangular shape.

12. A device for sealing a pressure medium-driven rotary vane-type motor in which two sealing surfaces to be sealed are defined between a collar of a motor shaft having an axis and a motor end cover and extended at right angles relative to each other, the sealing device comprising a prestressed sealing ring mounted at said surface so as to simultaneously seal said surfaces against a pressure medium; a viscous elastic element prestressing said sealing ring, said sealing ring being made of a material having good sliding properties; and a guide ring positioned between said elastic element and said sealing ring in the direction of said axis said guide ring having a length in the direction of said axis that is at least greater than twice the length in the direction of said axis of said sealing ring, said sealing ring being positioned between said surfaces to be sealed and being pressed by said guide ring which is displaceable by a pressure medium and continually generates between said sealing ring and said surfaces a contact pressure which is greater than a working pressure of the pressure medium, said guide ring having an oblique surface for receiving said sealing ring.

13. A device for sealing a pressure medium-driven rotary vane-type in which two sealing surfaces to be sealed are defined between a collar of a motor shaft having an axis and a motor end cover and extended at right angles relative to each other, the sealing device comprising a prestressed sealing ring mounted at said surfaces so as to simultaneously seal said surfaces against a pressure medium; a viscous elastic element prestressing said sealing ring, said sealing ring being made of a material having good sliding properties; and a guide ring positioned between said elastic element and said sealing ring in the direction of said axis, said guide ring having a length in the direction of said axis that is at least greater than twice the length in the direction of said axis of said sealing ring, said sealing ring being positioned between said surfaces to be sealed and being pressed by said guide ring which is displaceable by a pressure medium and continually generates between said sealing ring and said sealing surfaces a contact pressure which is greater than a working pressure of the pressure medium, said guide ring having a rectangular recess; and a triangular intermediate ring, said recess receiving said sealing ring and said intermediate ring, said sealing ring being triangular in shape and having an oblique surface, said intermediate ring having an oblique surface corresponding to and abutting against the oblique surface of said sealing ring.

* * * * *